US008695171B2

(12) United States Patent
Colorado

(10) Patent No.: US 8,695,171 B2
(45) **Date of Patent: *Apr. 15, 2014**

(54) QUICK RELEASE APPARATUS FOR AN SCBA FRAME

(71) Applicant: Fire Innovations LLC, Petaluma, CA (US)

(72) Inventor: Juancarlos Colorado, Petaluma, CA (US)

(73) Assignee: Fire Innovations LLC, Petaluma, CA (US)

( * ) Notice: Subject to any disclaimer, the term of this patent is extended or adjusted under 35 U.S.C. 154(b) by 46 days.

This patent is subject to a terminal disclaimer.

(21) Appl. No.: 13/724,052

(22) Filed: Dec. 21, 2012

(65) Prior Publication Data

US 2013/0111714 A1 May 9, 2013

Related U.S. Application Data

(63) Continuation of application No. 12/105,696, filed on Apr. 18, 2008, now Pat. No. 8,336,171.

(60) Provisional application No. 60/913,230, filed on Apr. 20, 2007, provisional application No. 60/985,948, filed on Nov. 6, 2007.

(51) Int. Cl.
*A44B 17/00* (2006.01)

(52) U.S. Cl.
USPC ..... 24/3.7; 24/580.1; 224/675

(58) Field of Classification Search
USPC ..... 24/3.7, 573.09, 578.1, 580.1, 578.13, 24/578.17, 579.09, DIG. 37; 224/675, 262, 224/637; 405/186
See application file for complete search history.

(56) References Cited

U.S. PATENT DOCUMENTS

| | | | | |
|---|---|---|---|---|
| 3,191,828 | A | 6/1965 | Senne | |
| 3,957,183 | A | 5/1976 | Gadberry | |
| 4,049,164 | A | 9/1977 | Sullivan et al. | |
| 4,327,851 | A | 5/1982 | Feathers | |
| D342,666 | S | 12/1993 | DePack | |
| 5,362,022 | A | 11/1994 | McLoughlin et al. | |
| 5,724,707 | A * | 3/1998 | Kirk et al. | 24/3.7 |
| 5,732,867 | A | 3/1998 | Perkins et al. | |
| 5,823,414 | A | 10/1998 | Gal et al. | |
| 5,987,717 | A | 11/1999 | Peterson et al. | |
| 6,732,834 | B2 | 5/2004 | Colorado | |
| 7,028,873 | B1 | 4/2006 | Collier et al. | |
| 7,080,430 | B2 | 7/2006 | Wemmer | |
| 7,240,404 | B2 | 7/2007 | Flossner | |

(Continued)

*Primary Examiner* — Jack W. Lavinder
(74) *Attorney, Agent, or Firm* — Craig M. Stainbrook; Stainbrook & Stainbrook, LLP

(57) ABSTRACT

A quick release apparatus for rapid disconnection of a waist belt from a self-contained breathing apparatus support frame, including first and second connector elements disposed on either of the support frame or the waist belt for selective connection of the support frame to the waist belt, first and second quick release pull straps releasably coupled to the first and second connectors, each of the pull straps having a quick release handle portion for grasping with a hand. A users pulls one of the quick release handle portions away from the waist belt to accomplish a partial release of the waist belt from the support frame, and by pulling both of said handle portions, the waist belt is fully decoupled from the support frame, such that the self-contained breathing apparatus may be removed by the wearer without also having to unbuckle or to remove the waist belt.

8 Claims, 17 Drawing Sheets

(56) References Cited

U.S. PATENT DOCUMENTS

| | | | | |
|---|---|---|---|---|
| 7,503,535 | B2 | 3/2009 | Ziaylek | |
| 7,526,842 | B2 | 5/2009 | Wemmer | |
| 7,694,862 | B2 | 4/2010 | Bergeron | |
| 8,336,171 | B2 * | 12/2012 | Colorado | 24/3.7 |
| 2007/0090137 | A1 | 4/2007 | Kim | |
| 2008/0078911 | A1 | 4/2008 | Ziaylek | |

* cited by examiner

FIG. 3C
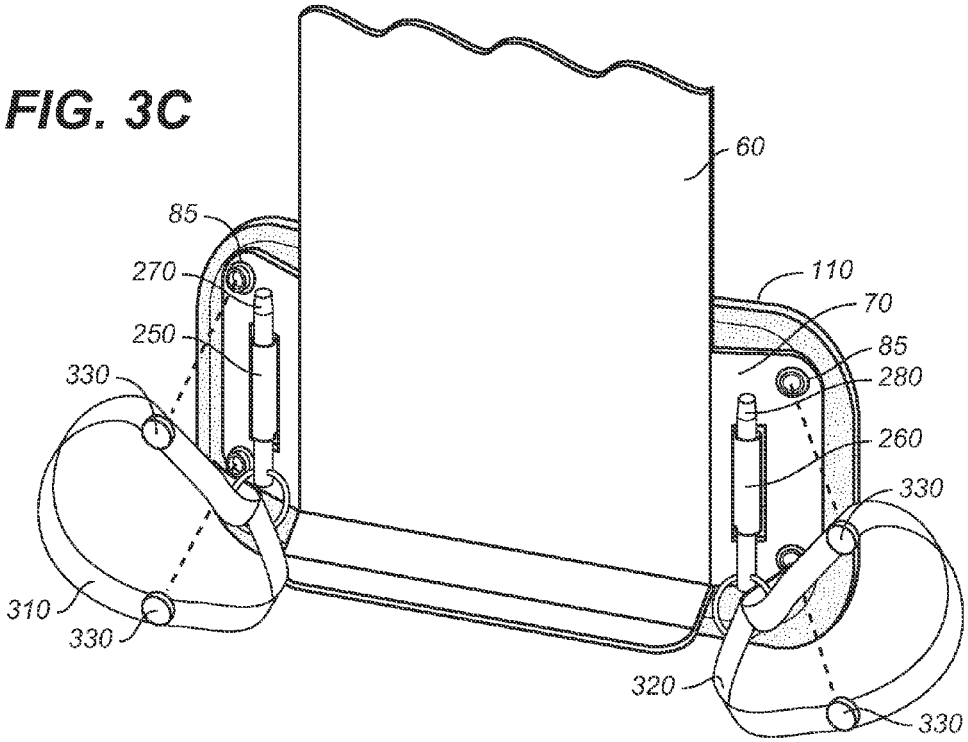
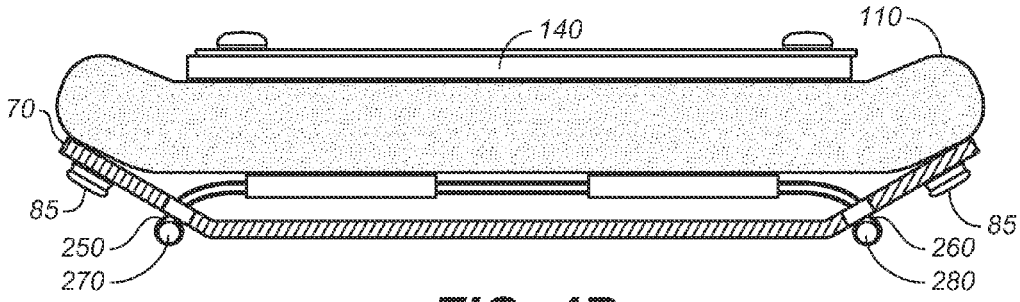
FIG. 4B

QUICK RELEASE APPARATUS FOR AN SCBA FRAME

CROSS REFERENCES TO RELATED APPLICATIONS

The present application is a continuation of U.S. Utility patent application Ser. No. 12/105,696, filed Apr. 18, 2008 (Apr. 18, 2008), and issued Dec. 25, 2012 (Dec. 25, 2012) as U.S. Pat. No. 8,336,171; which, in turn, claims the benefit of the filing dates of U.S. Provisional Patent Application Ser. No. 60/913,230, filed Apr. 20, 2007 (Apr. 20, 2007), and U.S. Provisional Patent Application Ser. No. 60/985,948, filed Nov. 6, 2007 (Nov. 6, 2007).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to firefighter safety equipment, and more particularly to a harness system for a self-contained breathing apparatus (hereinafter referred to as an "SCBA"). Even more particularly, the present invention relates to a quick-release harness system for connecting an SCBA to a firefighter or rescue worker's turnout gear trucker's belt such that the quick-release system may be disconnected and separated from the trucker's belt in a matter of only a few seconds.

2. Discussion of Related Art Including Information Disclosed Under 37 CFR 1.97, 1.98

People celebrate and wonder at the heroics of firefighters. At the same time, they often romanticize firefighting work, imagining it to be some kind of athletic adventurism that provides an opportunity to show bravery and save people without having to be shot at. In truth, firefighters bear a heavy burden: Their jobs do not include the mere opportunity to rescue people and property from peril; they include the duty to rescue. And in discharging that duty, firefighters regularly inhabit a chaotic and terrifying hell world of flames and superheated air that blisters their skin and sears their eyes, billowing clouds of toxic smoke that instantly burns and damages their lungs, floors that collapse under them to bone breaking effect, roofs and ceilings that collapse over them to bone crushing effect. All the while, firefighters have to maintain their cool, in every respect, and act in the interests of others.

To make such a world navigable and survivable, firefighters don safety and operational equipment that is designed to strike a balance between providing physical maneuverability and providing protection from heat, fire and smoke. Due to the stakes, ongoing efforts are made to incorporate improved technology in firefighter turnout gear and firefighting equipment, and a very high state of maturity has been achieved. Among the many technical improvements are improvements related to the waist belts firefighters wear either inside or outside their turnout coat. Indeed, the present inventor has made contributions to the art in this field, including a combination trucker's belt and extrication harness combination shown in U.S. Pat. No. 6,732,834, comprising a waistband having a number of integral features, including ax holder rings, and a strip of fabric sewn into the waistband so as to form a succession of fabric loops adapted for carrying equipment and tools. The apparatus shown in the '834 patent provided improved means for carrying and deploying an extrication line in the event it was necessary to rapidly egress from a multistory building. A better balance was struck.

However, a perfect balance remains elusive, and one circumstance in which is it particularly difficult to strike the right balance between safety and function is where rescue operations are undertaken in confined spaces, such as collapsed or collapsing buildings. Breathing apparatus is necessary in many or most of those situations, and to provide assisted breathing a firefighter or rescue worker must wear some kind of self-contained breathing apparatus (or "SCBA"). The typical apparatus include three principal components, including a tank containing breathable air under high pressure (typically 2200 psi to 4500 psi), a pressure regulator, and an inhalation mouthpiece, mouth mask, or face mask. These elements are operatively coupled and mounted on an SCBA carrying frame, which generally resembles a backpack frame, including shoulder straps, a rigid mid-frame member, a lower lumbar support, and a hip/waist belt (refer to FIG. 1).

While the SCBA provides breathable air for hostile environments, it also greatly limits movement, and in some circumstances it can impede passage into or through a confined space. For instance, when a roof or ceiling collapses, some structures within the building (sturdy desks, filing cabinets, tables, and the like) may actually support a substantial portion of the roof or ceiling slightly above the floor, possibly saving a person from being crushed. It thus may also provide a rescue worker with a narrow passage through which to get to the trapped person. However, the sheer bulk of the SBCA can prevent such passage, and the rescue worker may be forced to remove the SCBA by unbuckling the waist belt and slipping off the shoulder straps. This is a cumbersome and time-consuming maneuver.

Furthermore, in some instances, to effect an escape or to make passage through a confined space, it may be necessary to abandon the SCBA. When this dire action is taken, the rescue worker may be left without numerous tools and safety equipment disposed on his waist belt, and the rescue worker may be left without the means to carry critical gear other than by using his hands. This greatly handicaps the rescue worker and limits the tasks he can perform and the safety under which he can operate.

It would therefore be desirable to have means to rapidly release an SCBA unit from a waist belt while also retaining the waist belt with its attached tools. While several firefighter/rescue worker support harnesses have been proposed to provide easy removal and adjustment, to the knowledge of the present inventor, none disclose, teach, or suggest a quick release system for selectively attaching and detaching a trucker's belt from an SCBA support frame.

BRIEF SUMMARY OF THE INVENTION

The present invention is an improved system for connecting an SCBA frame to a waist belt.

It is a first object of the present invention to provide a quick release system for selectively detaching a rescue worker SCBA frame from a hip/waist belt to which it is connected.

It is therefore an object of the present invention to provide a new and improved method and apparatus for rapid release and detachment of an SCBA breathing apparatus to facilitate unfettered movement in confined spaces.

It is another object of the present invention to provide a new and improved hip and waist belt connection apparatus for connecting the lower lumbar support member of an SCBA frame to a turnout gear hip and waist belt.

A further object or feature of the present invention is a novel method and apparatus for selective disengagement from an SCBA unit having safety features that require a conscious intention to remove the unit and prevent the inadvertent release of the unit.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 3B is a partial front left perspective view showing the elements for connecting the lumbar support pad to the lumbar portion of an SCBA frame;

FIG. 3C is an upper left perspective view showing the lumbar pad connecting and secured with pins to the lumbar portion of the SCBA frame;

FIG. 4B is a top plan view corresponding to FIG. 3C;

DETAILED DESCRIPTION OF THE INVENTION

Figure 1:
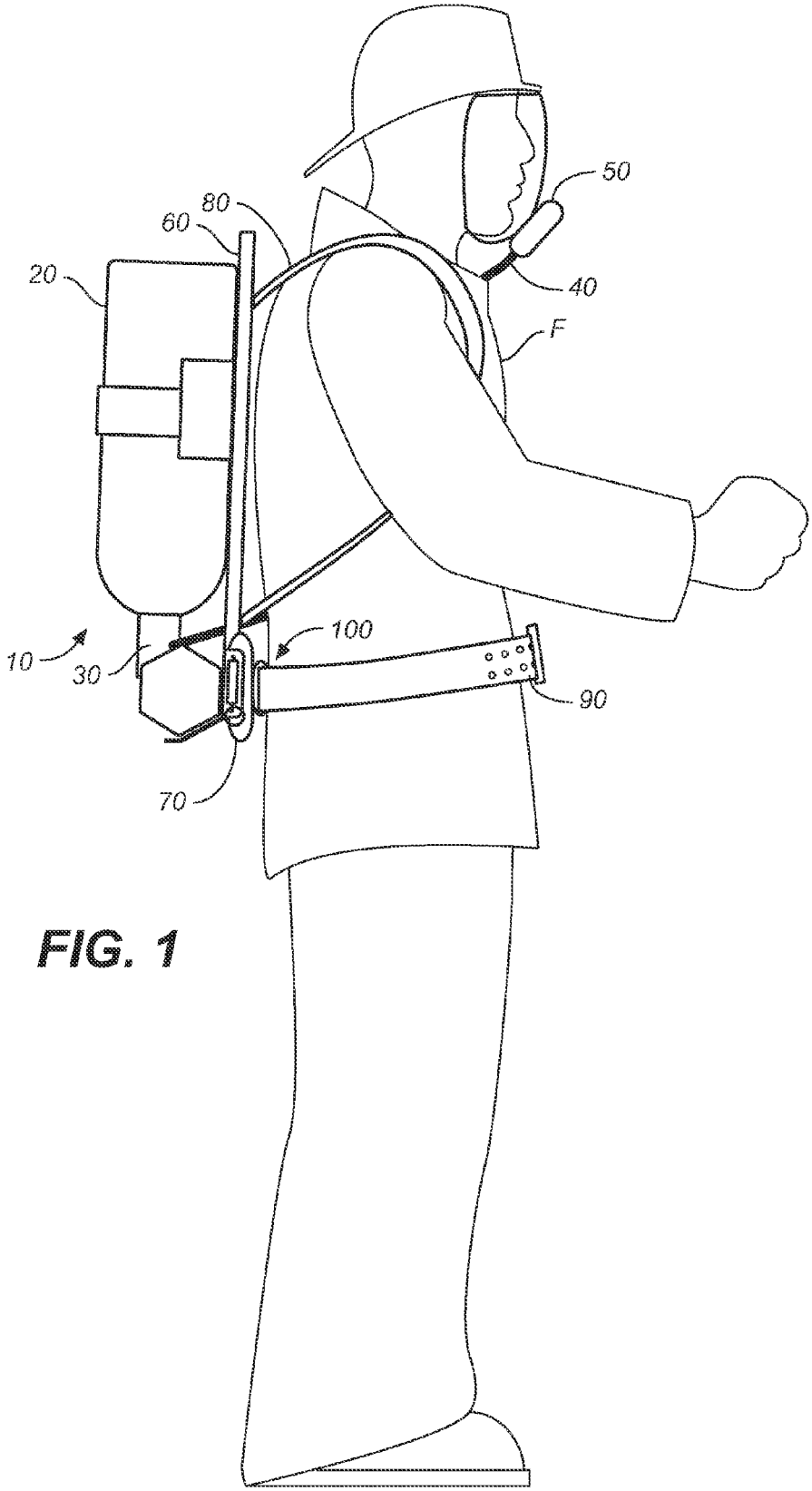
FIG. 1 is a schematic side view in elevation showing a firefighter wearing a self-contained breathing apparatus, which is attached at the lower lumbar support member of the SCBA frame to a trucker's belt using the quick release system of the present invention.

Referring first to FIGS. 1 through 4B, wherein like reference numerals refer to like components in the various views, there is illustrated therein a first preferred embodiment of a new and improved quick release apparatus for an SCBA frame, generally denominated 100 herein.

FIG. 1 shows a firefighter F wearing a self-contained breathing apparatus 10, which includes a tank 20 with a pressure regulator 30, an air line 40, and a protective inhalation face mask 50. The tank is mounted and supported on a rigid frame 60 having, among other things, a lower lumbar support plate 70 and shoulder straps 80. The frame is connected at its lower lumbar support plate to a trucker's belt 90 using the quick release apparatus of the present invention 100.

Figure 2A:
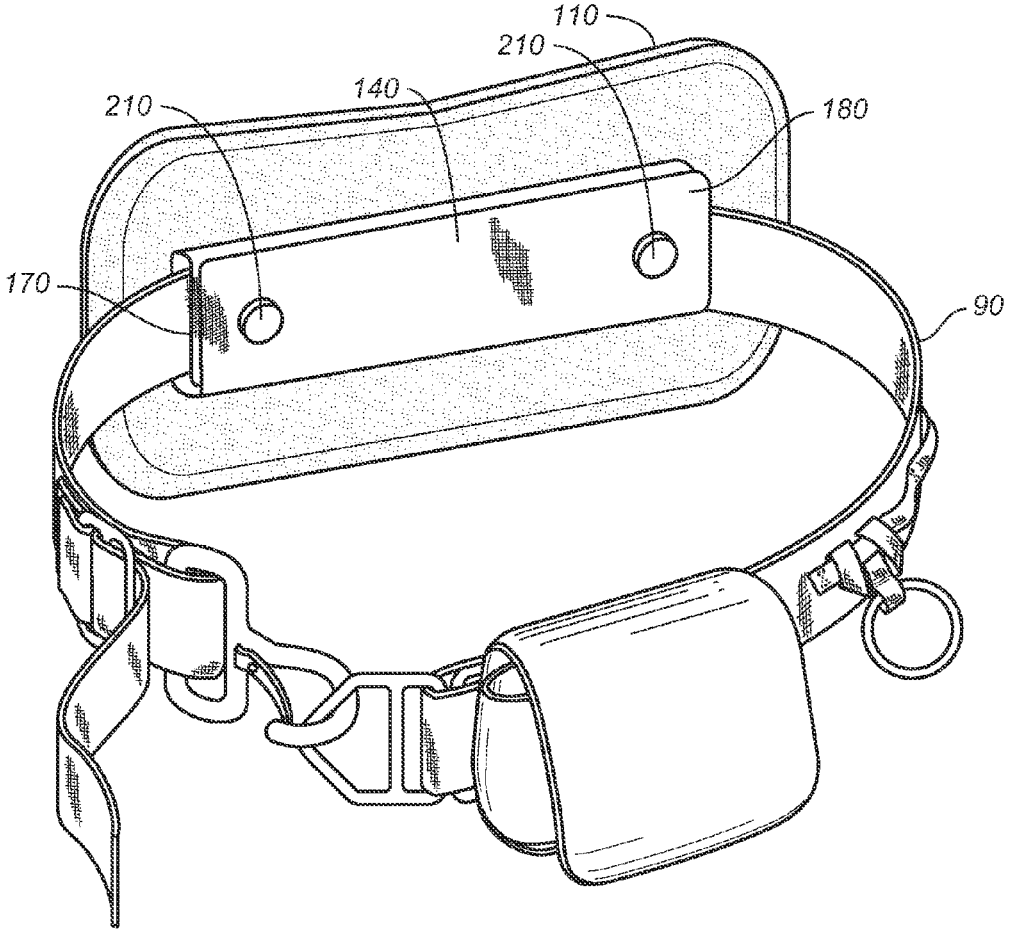
FIG. 2A is an upper front right perspective view showing the novel quick release system disposed on a trucker's belt.
Figure 2B:
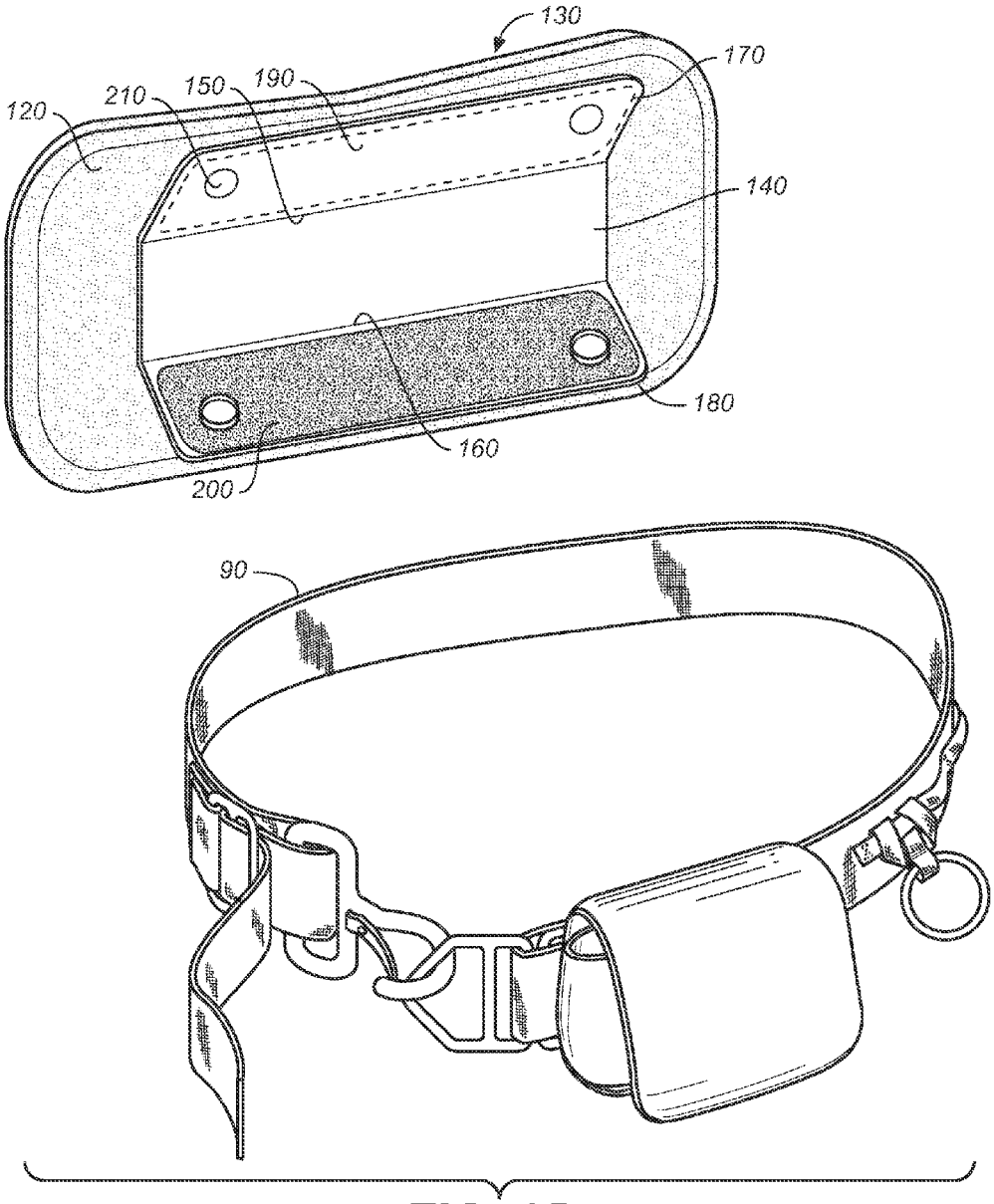
FIG. 2B is an upper front right perspective view of the lumbar support pad element detached from a trucker's belt.
Figure 3A:
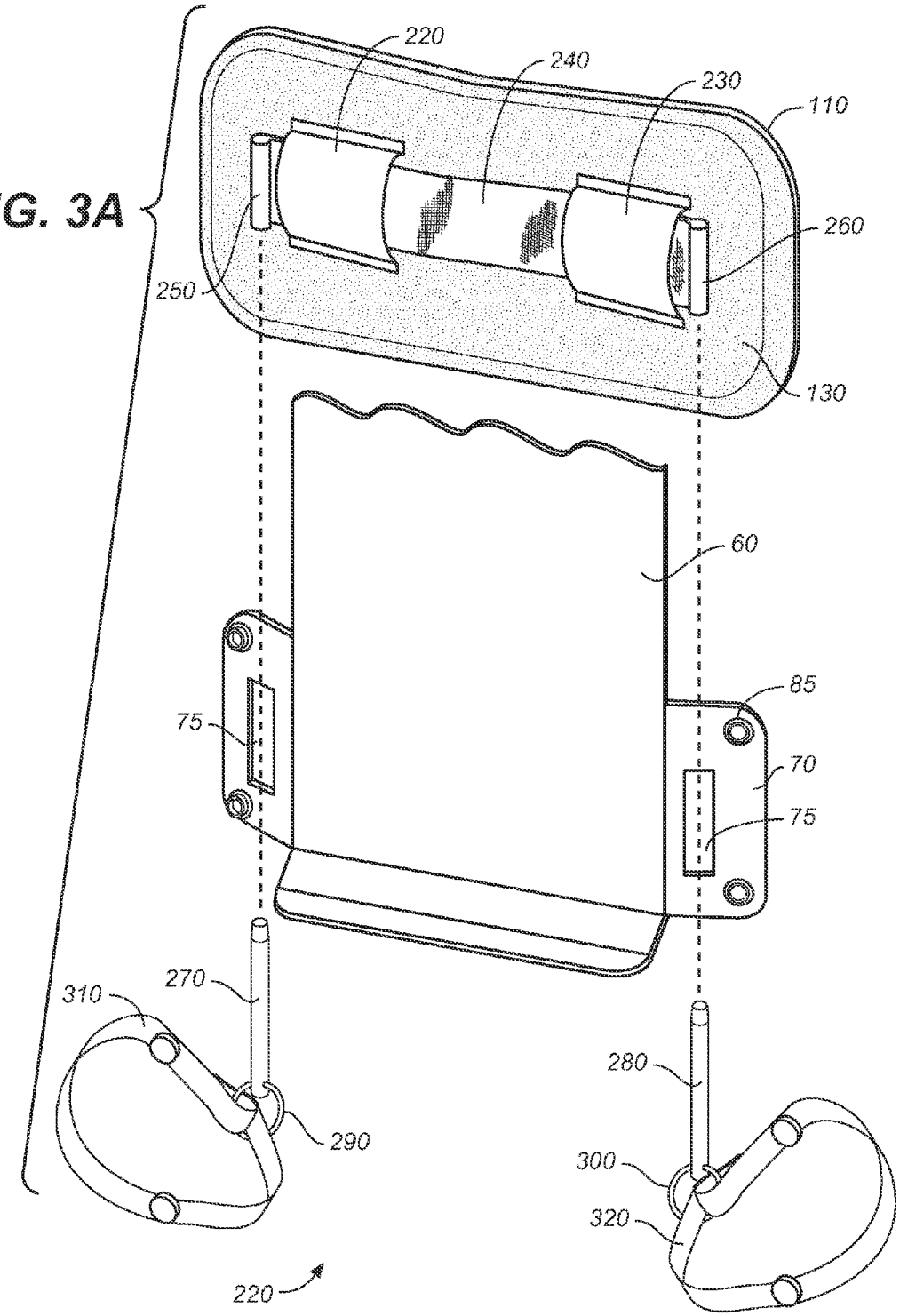
FIG. 3A is an upper front left exploded view of the quick release system for an SCBA frame of the present invention.
Figure 4A:
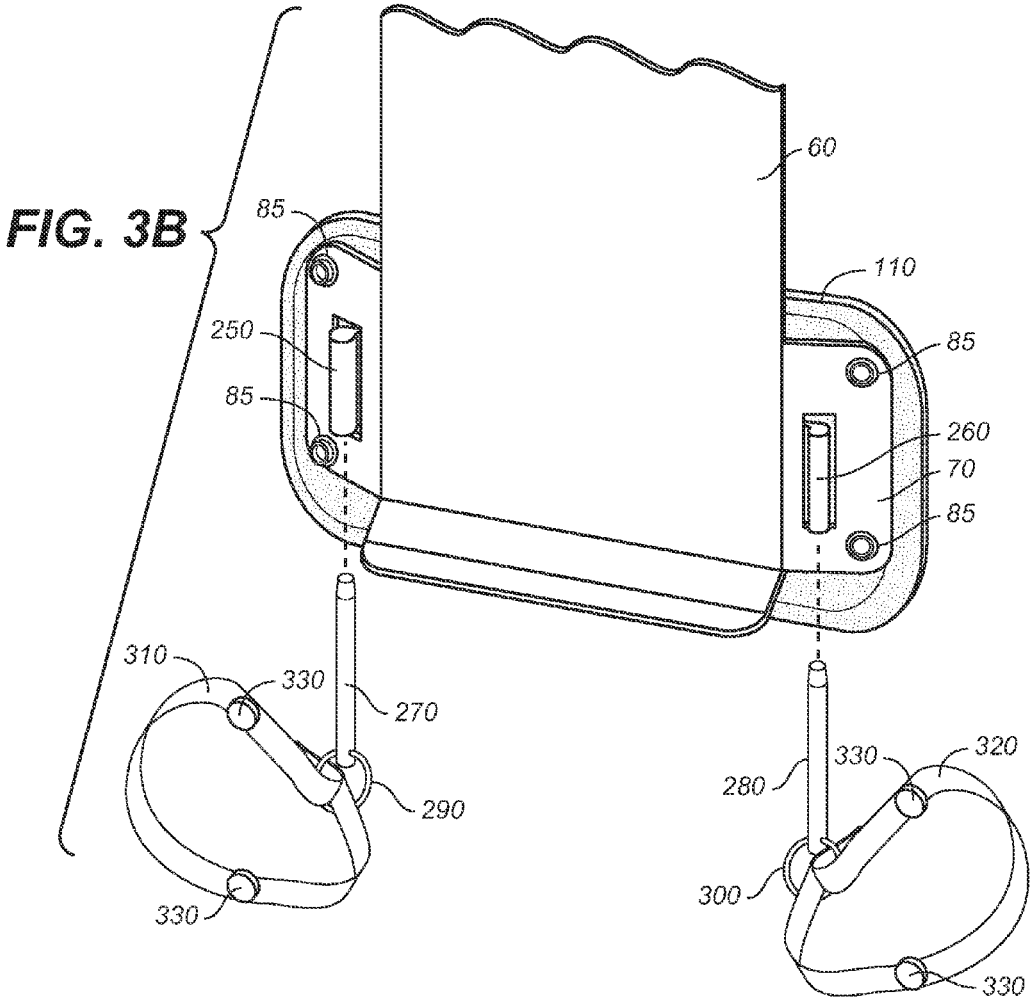
FIG. 4A is a top plan view corresponding to FIG. 3B.
Figure 4A:
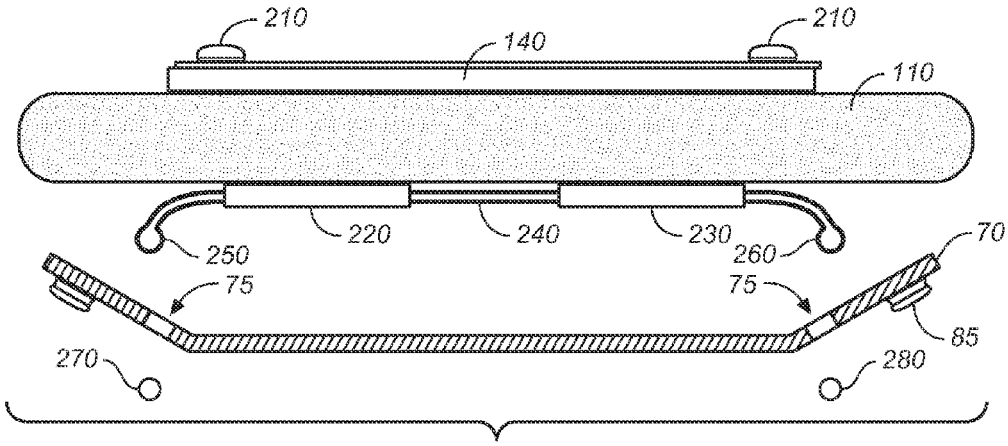

FIG. 2A is an upper right perspective view showing the lumbar pad portion of the novel quick release system releasably disposed on a trucker's belt, while FIG. 2B is the same view showing the lumbar pad portion detached from the trucker's belt. These views show the structural and operational features of a principal unit of the present invention and the general manner in which it is coupled to a trucker's belt 90. The elements include a generally rectangular frame-connecting lumbar support pad 110 for attachment to the interior side of the lower lumbar support plate 70. The lumbar support pad includes a front side 120, a rear side 130, and a selectively openable belt capturing sleeve 140 having an upper fold 150, a lower fold 160, upper and lower flaps, 170, 180, each having hook and loop fastener material, 190, 200, respectively (the former in phantom), and snaps 210. The frame-connecting lumbar support pad is preferably fabricated of aramid fiber webbing (such as KEVLAR® or NOMEX®) or other suitably sturdy natural or synthetic, heat and fire resistant material, and the webbing may cover a padding of some kind, according to the comfort needs and preferences of the wearer. [KEVLAR and NOMEX are both registered trademarks of E.I. du Pont de Nemours and Company.]

Referring now to FIGS. 3A through 4B, the frame-connecting lumbar support pad also includes frame connectors 220 for releasable connection to the SCBA lower lumbar support plate 70. It will be noted that the SCBA lower lumbar support plate must be modified and adapted to accommodate the frame connectors, and such modification preferably includes the provision of two generally vertically disposed slots 75 and the provision of snap elements 85 riveted to the SCBA frame.

In the preferred embodiment, the frame connectors comprise first and second fabric sleeves 220, 230 sewn into the rear side 130 of the lumbar pad 110, a strap 240 inserted through the sleeves and having loop ends 250, 260 adapted for insertion through slots 75 and to accommodate removable pins 270, 280, which, when inserted through the loop ends of strap 240 affixes the lumbar pad to the SCBA frame and effectively prevents removal of the lumbar pad unless the pins are removed from the loop ends. The lower ends of each pin includes a pin ring 290, 300, to which a pull strap 310, 320 is attached, and a snap element 330 is disposed along the length of each of the pull straps. The snap elements mate with corresponding snap elements riveted to the SCBA frame to prevent inadvertent removal of the pins from the loop ends.

As will be readily appreciated, installation of the quick release system is a simple matter. First, the loop ends 250 and 260 are inserted through slots 75, and pins 270, 280 are inserted into the bottom opening of the loop ends. Next, snap elements 330 on pull straps 310, 320 are mated to the corresponding snap elements 85 on the lumbar support 70 of SCBA frame 60. At this point, the lumbar pad is fully installed on the SCBA frame.

Next, to connect the SCBA frame to a trucker's belt, the belt-capturing member 140 is opened and a length of the trucker's belt is placed between the upper and lower folds 150, 160. The upper and lower flaps 170, 180, are folded over, pressed together to approximate the hook and loop fastener surfaces, and the flaps are then snapped shut using snaps 210.

If a firefighter encounters a situation in which his safety could depend upon quickly jettisoning the SCBA and its frame while still keeping the trucker's belt and any gear carried on the belt, he need only grab pull straps 310, 320 to release snaps 330 and then pull the pins 270, 280 downwardly and out of loop ends 250, 260. Once the pins are pulled, the SCBA frame is physically released from the waist belt and the firefighter need only slip off the shoulder straps to free himself from the SCBA unit. The trucker's waist belt remains around his waist and provides easy access to any tools the worker has carried on his person into the perilous circumstances.

Referring next to FIGS. 5 through 11C, wherein like reference numerals refer to like components in the various views, there is illustrated therein a second preferred embodiment of the new and improved quick release apparatus for an SCBA frame, generally denominated 500 herein.

Figure 5:
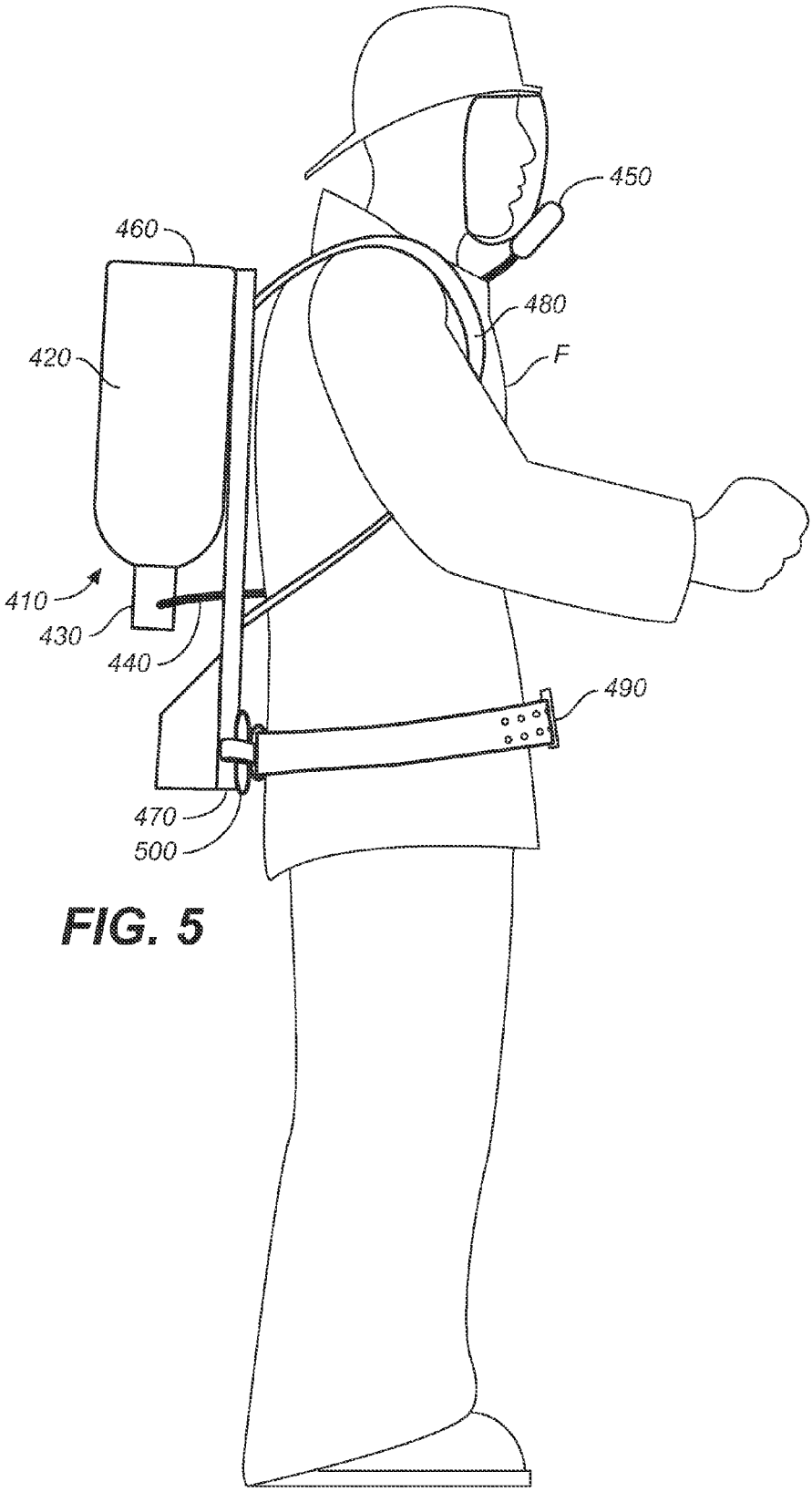
FIG. 5 is a schematic side view in elevation showing a firefighter wearing a second preferred embodiment of the self-contained breathing apparatus of the present invention, again showing the apparatus attached at the lower lumbar support member of the SCBA frame to a trucker's belt using the quick release system of the present invention.

FIG. 5 shows a firefighter F wearing a self-contained breathing apparatus 410, which includes a tank 420 with a pressure regulator 430, an air line 440, and a protective inhalation face mask 450. The tank is mounted and supported on a rigid frame 460 having, among other things, a lower lumbar support plate 470 and shoulder straps 480. The frame is connected at its lower lumbar support plate 470 to a trucker's belt 490 using the quick release apparatus of the present invention 500.

Figure 6A:
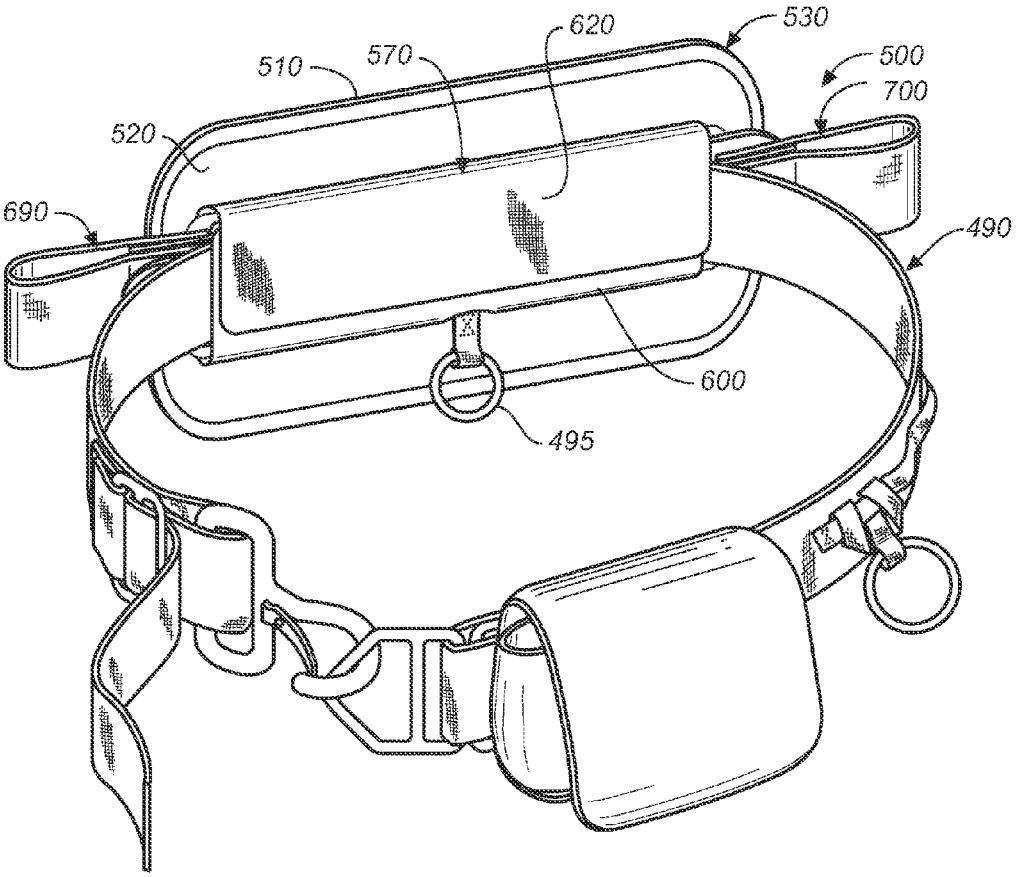
FIG. 6A is a perspective view showing the second preferred embodiment disposed on a trucker's belt.
Figure 6B:
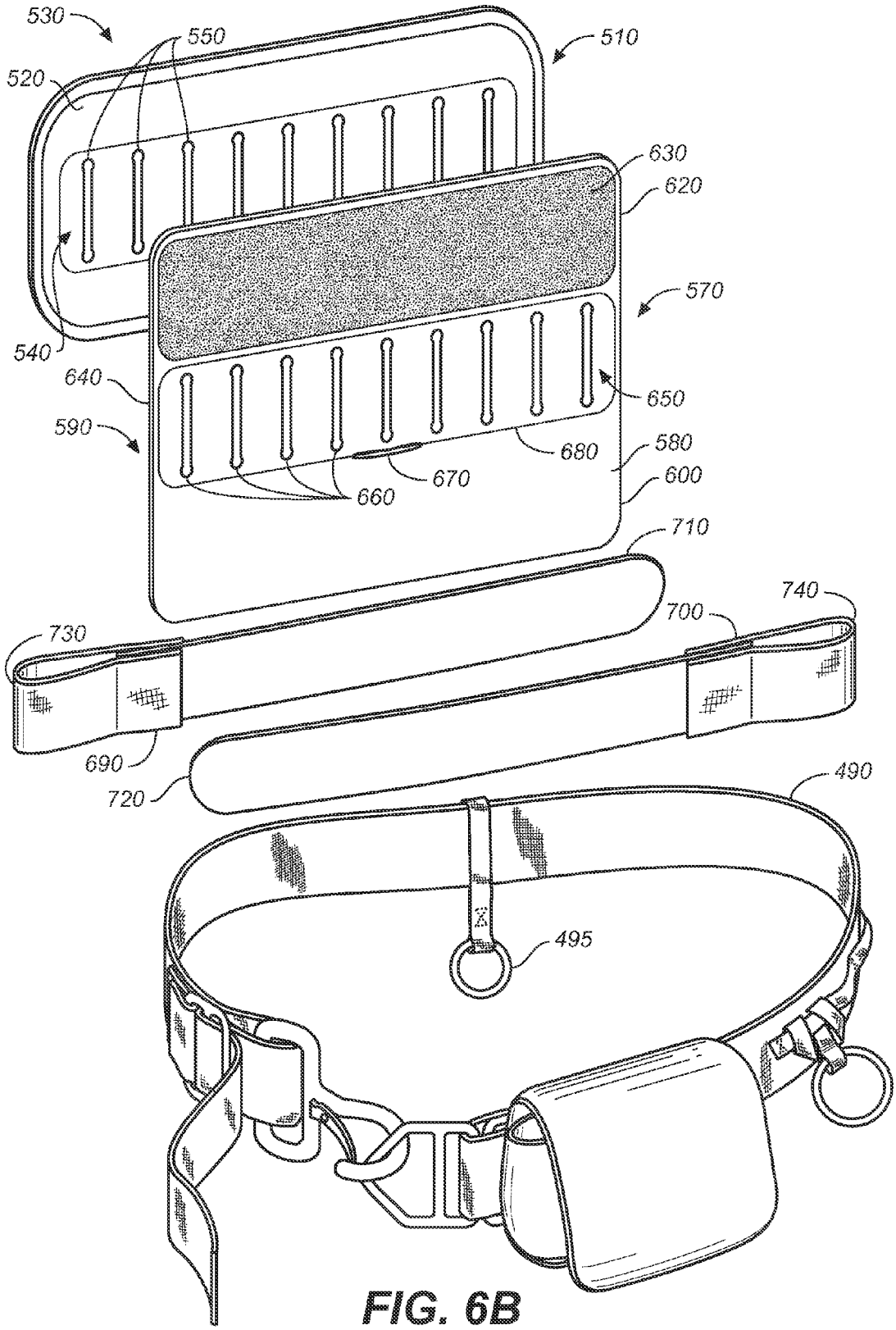
FIG. 6B is an exploded view thereof.

FIG. 6A is a perspective view showing the second preferred embodiment of the novel quick release system disposed on a trucker's belt, while FIG. 6B is an exploded view thereof. These views show the structural and operational features of the present invention and the general manner in which the quick release apparatus is coupled to a trucker's belt 490. The elements include a generally rectangular frame-connecting lumbar support pad 510 having a front side 520, a rear side 530, and a medial longitudinally disposed linear array of loops 540 defined by spaced-apart parallel slots 550 cut into the front side. The frame-connecting lumbar support pad is preferably fabricated of the same materials as that of the first preferred embodiment, namely, aramid fiber webbing or another sturdy natural or synthetic, heat and fire resistant material. Further, the addition of padding is an option, albeit a desirable one.

Figure 8A:
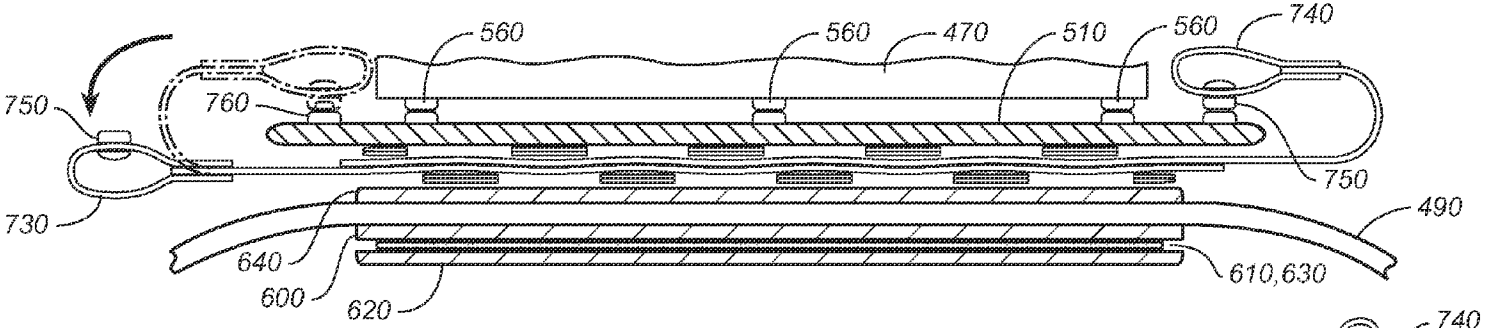
FIG. 8A is a cross-sectional top view taken along section line 8-8 of FIG. 7A, showing the frame-connecting member disposed on an SCBA lumbar support member, and the belt connection member of the second preferred embodiment demountably interwoven to the frame-connecting member using first and second quick release straps (one strap is shown unsnapped from the frame-connecting member and poised for removal)
Figure 8B:
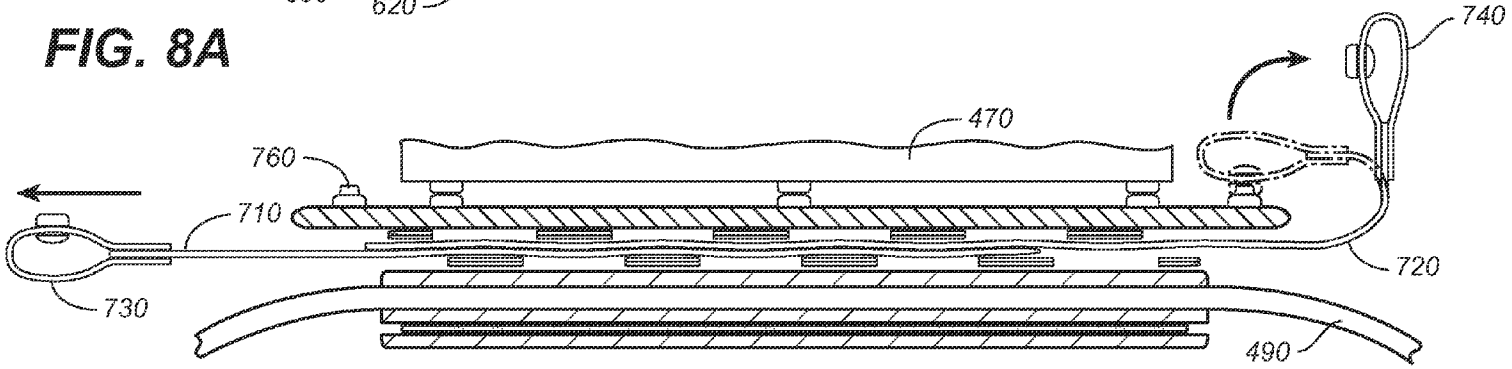
FIG. 8B is a cross-sectional top view taken along section line 8-8 of FIG. 7A, showing one quick release strap being slidably removed while a second quick release strap is unsnapped and positioned for removal.
Figure 8C:
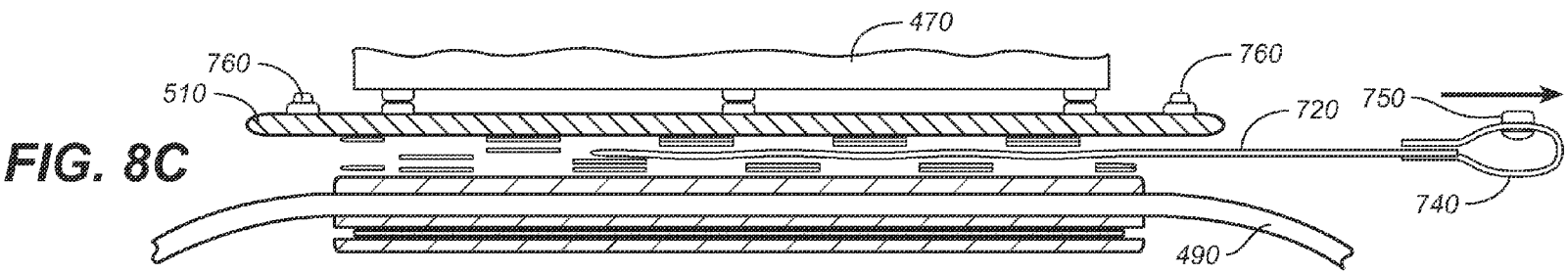
FIG. 8C is a cross-sectional top view taken along section line 8-8 of FIG. 7A, showing the second quick release strap being slidably removed.
Figure 8D:
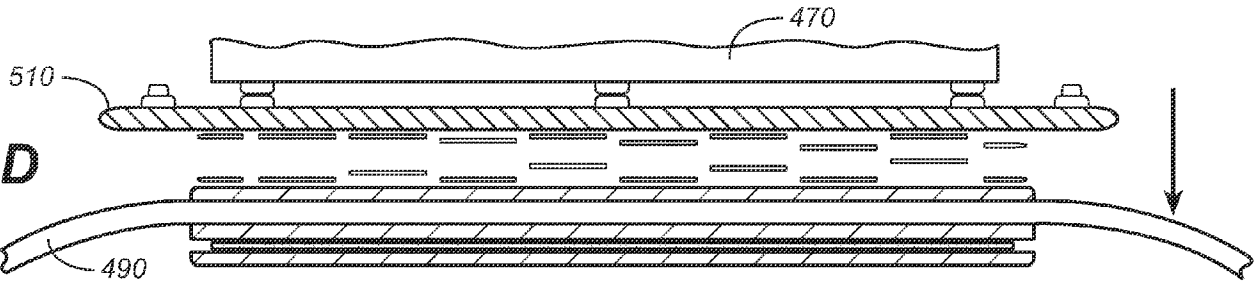
FIG. 8D is a cross-sectional top view taken along section line 8-8 of FIG. 7A, showing both quick release straps fully removed and the belt connection member and trucker's belt separating from the frame-connecting member and SCBA frame.
Figure 8E:
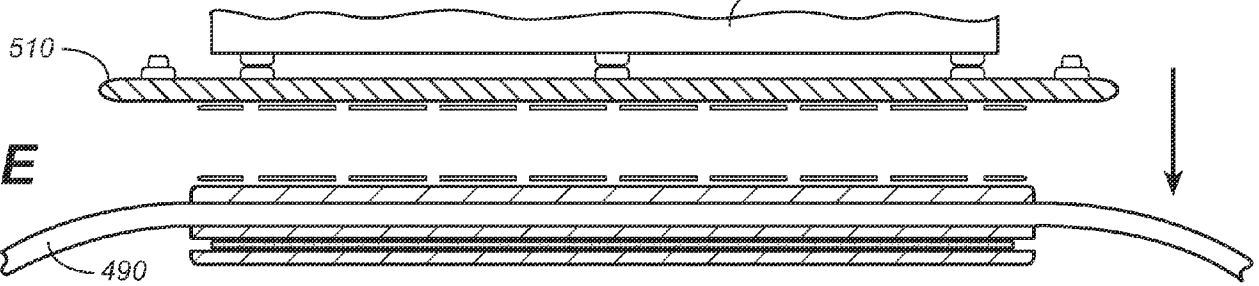
FIG. 8E is a cross-sectional top view taken along section line 8-8 of FIG. 7A, showing further separation of the belt-capturing member and belt from the frame-connecting member and frame.
Figure 8F:
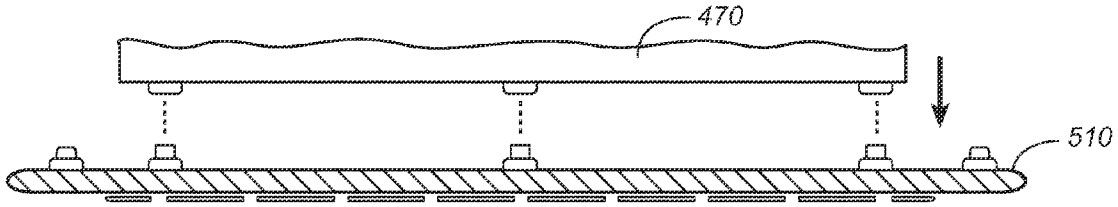
FIG. 8F is a cross-sectional top view taken showing the frame-connecting member being detached from the SCBA frame lower lumbar support plate.

Referring now to FIGS. 8 through 8F, the frame-connecting lumbar support pad also includes a plurality of frame connectors 560 for releasable connection to the SCBA lower lumbar support plate 470. The frame connectors may include one-way snaps, rivets, bolts, and the like, and the frame-connecting member may also be tailored and configured to include foldable elements which fold around and cooperate with structural elements of the lower lumbar support to provide a secure connection between the frame-connecting lumbar support pad and the lower lumbar support that will not become inadvertently disconnected during use. In the views, simple snaps are shown by way of illustration only, but such should be understood to comprise a schematic representation of the kinds of connectors described and well known in the art.

Figure 9A:
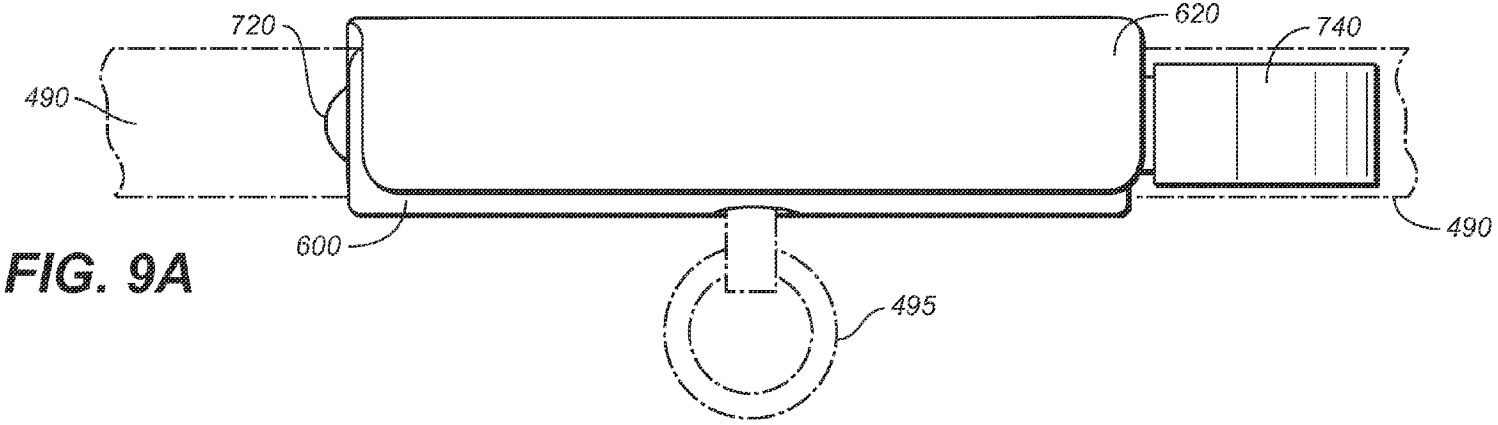
FIG. 9A is a front view in elevation showing the belt-capturing member foldably capturing a trucker's waist belt, one quick release strap slidably inserted into the loop connection elements.
Figure 9B:
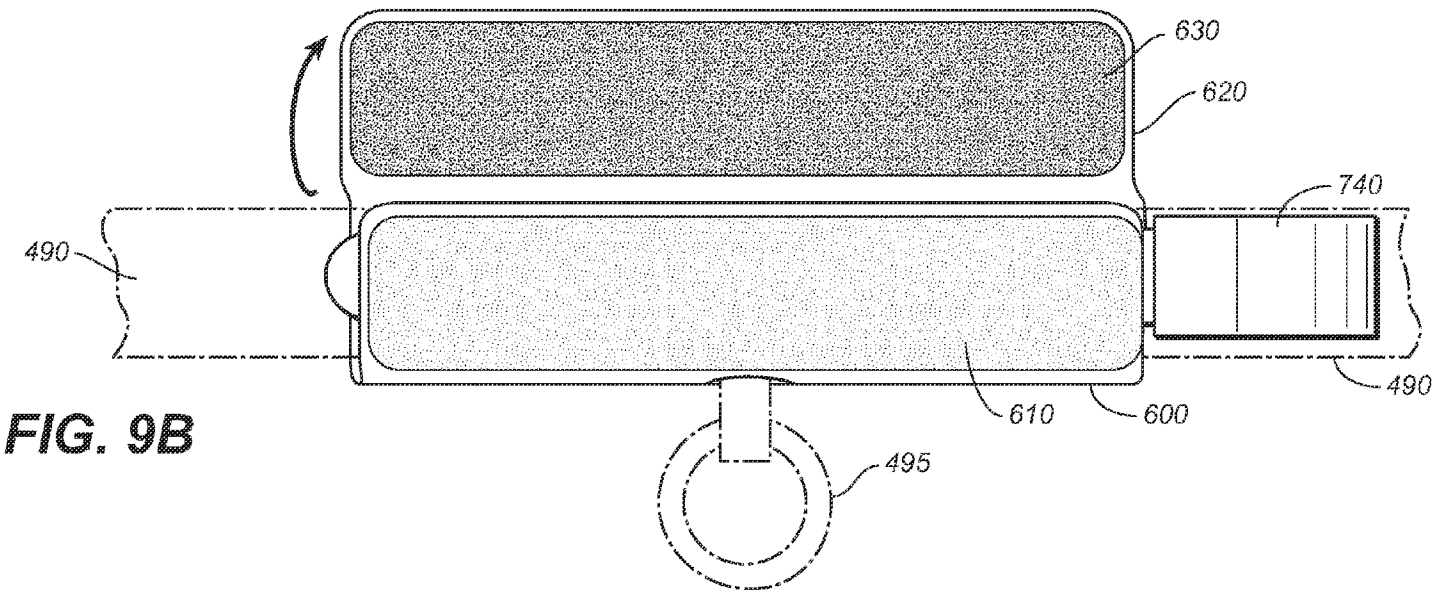
FIG. 9B shows the exterior flap of the belt-connection member opened.
Figure 9C:
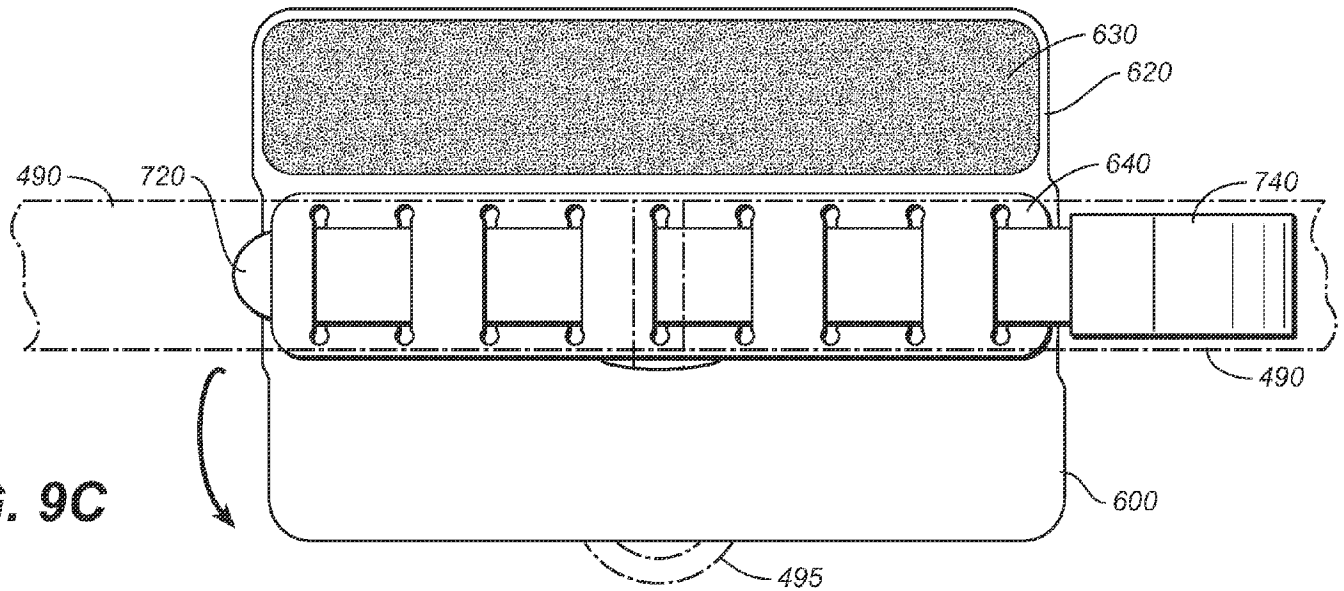
FIG. 9C shows the interior flap of the belt-connection member opened, exposing the loop connection elements and the single quick release strap slidably inserted into the loop connection elements.
Figure 10:
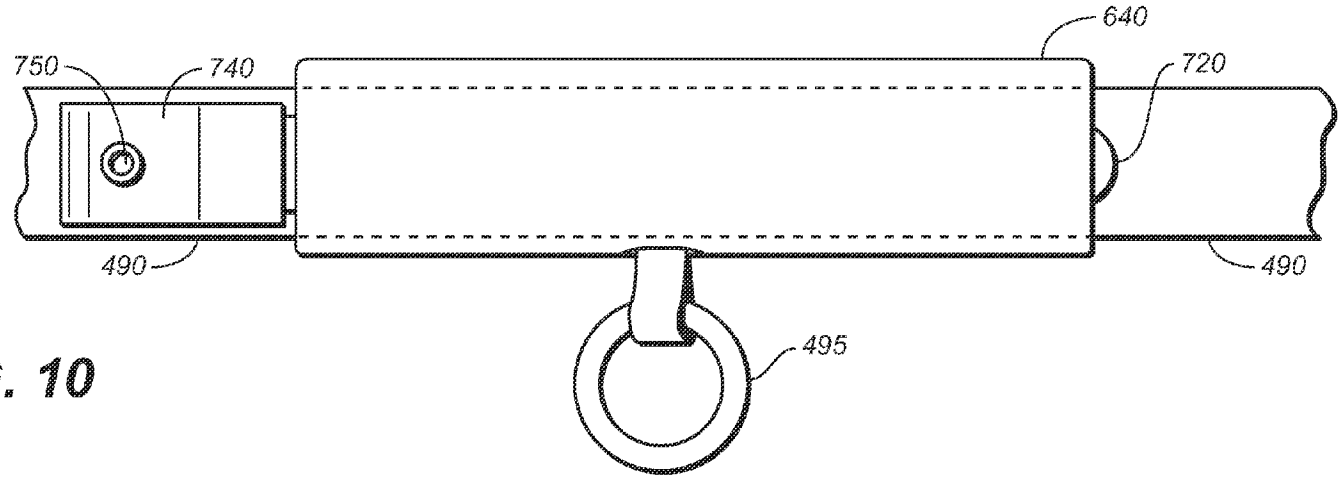
FIG. 10 is a rear view in elevation of the belt-connection member as shown in FIG. 9A.
Figure 11A:
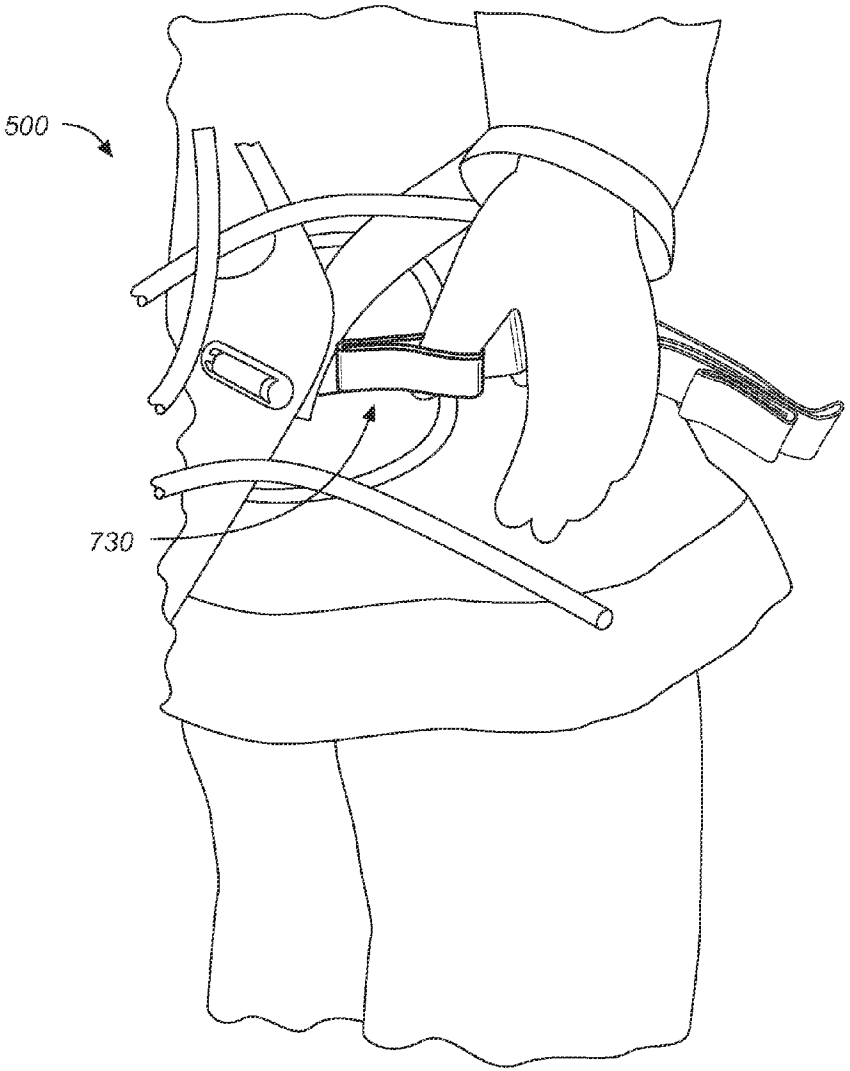
FIGS. 11A-C are upper rear perspective views showing detail of a firefighter pulling out one quick release strap from the quick release apparatus of the present invention while donning an SCBA unit.
Figure 11B:
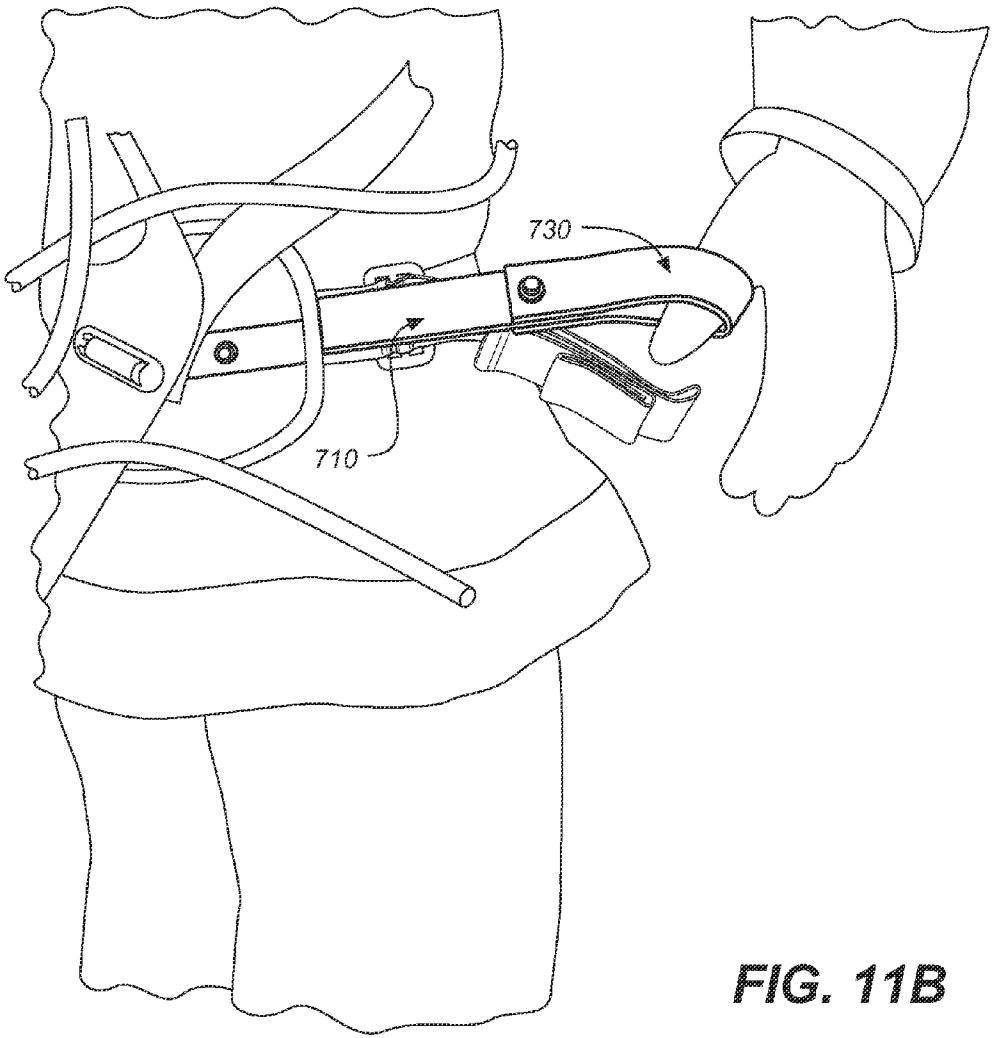
Figure 11C:
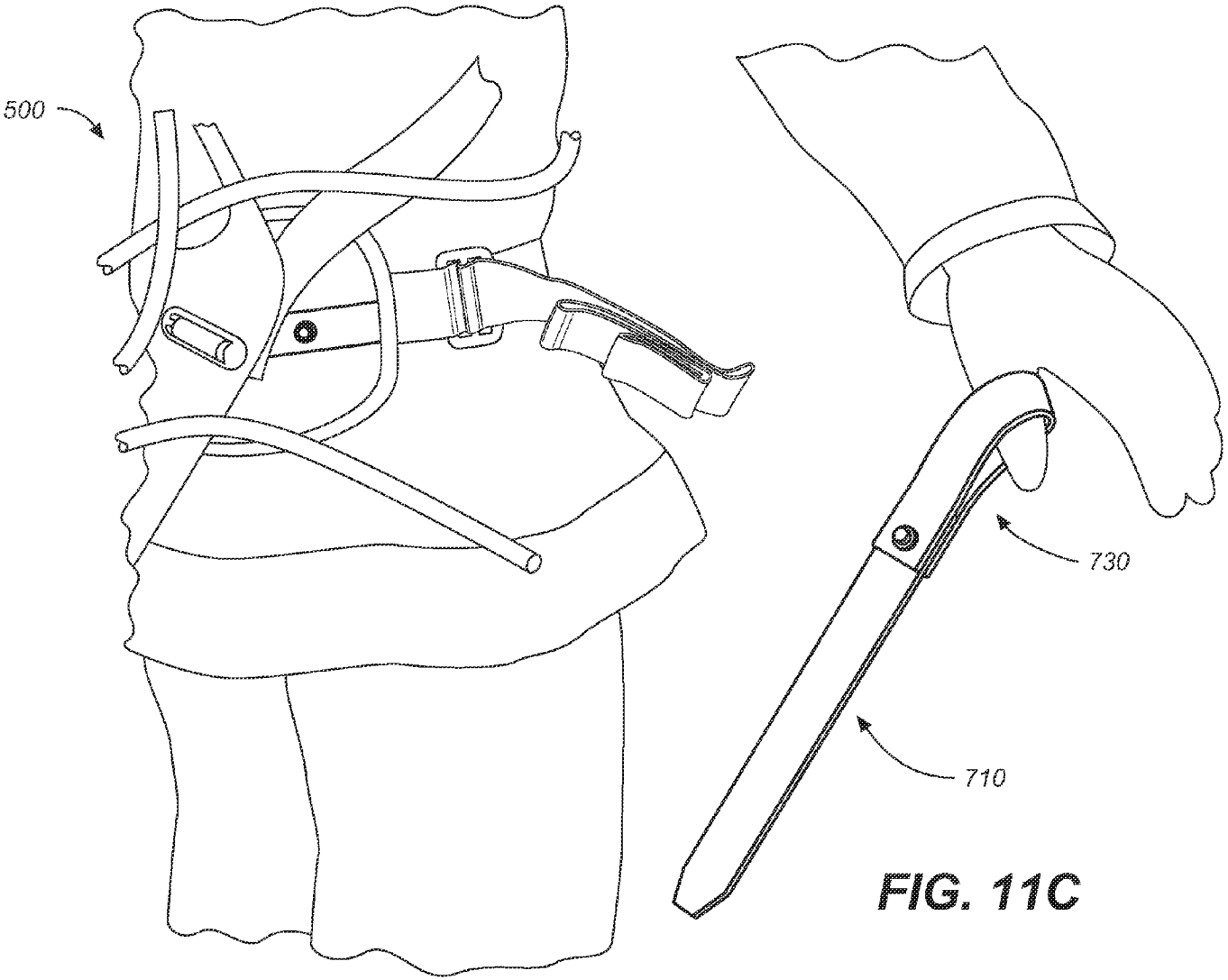

Still referring to FIGS. 6A and 6B, and now also to FIGS. 9A and 9B, the quick release system next includes a generally rectangular belt-capturing member 570 having a front side 580, a rear side 590, a lower (interior) flap 600 having hook and loop material 610 disposed on the rear side, an upper (exterior) flap 620 having hook and loop material 630 disposed on the front side that is complementary to the hook and loop material on the lower flap, and a medial portion 640 having a longitudinally disposed array of loops 650 defined by spaced-apart parallel slots 660. A hole or slot 670 may be cut along the lower flap fold 680 through which a tool ring and strap 495 sewn onto the trucker's belt may be inserted. This configuration provides means to prevent slippage of the belt-capturing member when worn.

The apparatus next includes at least one, and preferably two, quick release straps, 690, 700. Each strap includes a semi-flexible smooth plastic or metal planar portion 710, 720, respectively, and a loop or handle 730, 740, respectively, at its outboard end.

Figure 7A:
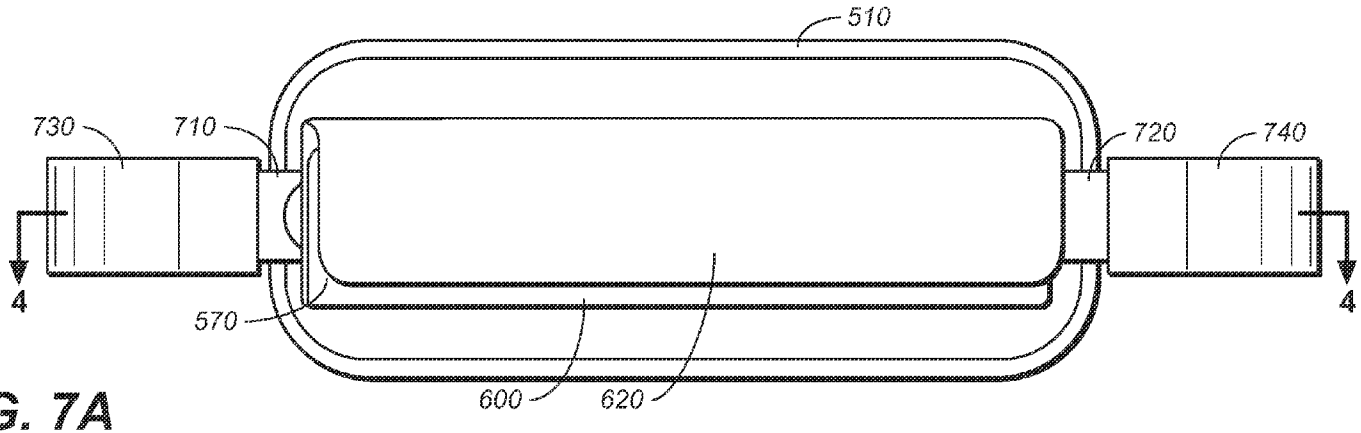
FIG. 7A is a front view in elevation of the second preferred embodiment of the quick release system for an SCBA frame of the present invention.
Figure 7B:
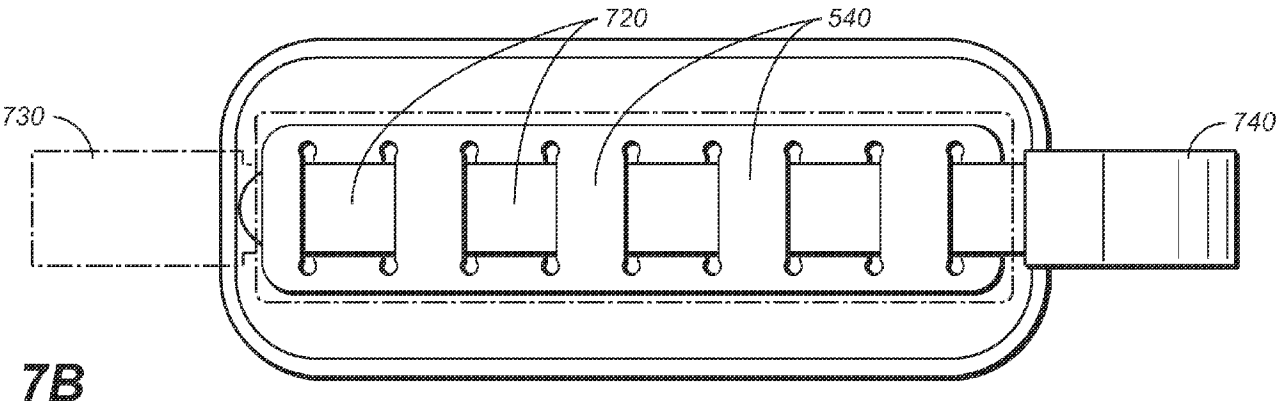
FIG. 7B is a front view in elevation showing the SCBA lumbar support frame-connecting member of the inventive apparatus, with one quick release strap removed.

FIG. 7A is a front view in elevation of the quick release system for an SCBA frame of the present invention, showing the belt-capturing member demountably coupled to the frame-connecting lower lumbar support pad, and both quick release straps inserted into the entire array of interwoven loops. FIG. 7B is the same view with the belt-capturing member and one quick release strap removed, the removed elements each shown in phantom lines.

As will be readily appreciated by reference now to FIGS. 8A through 8F, the belt-capturing member is selectively and demountably attached to the lower lumbar support pad by approximating the frame-connecting lower lumbar support pad front side and the belt-capturing member rear side and threadably inserting one or both of the straps through the parallel slots in each member in an interchanging sequence. This effectively interweaves the loops in the two elements. For increased security and to prevent the quick release straps from being inadvertently pulled out from the attached elements, snaps or other connection apparatus 750 may be disposed on the quick release handles for connection to a complementary connector or structure 760 on the frame-connecting lower lumbar support pad.

Referring now to both FIGS. 8A through 8F and FIGS. 11A through 11C, it will be seen that the belt-capturing member is rapidly released from the frame-connecting lower lumbar support pad (and thus from the SCBA unit) simply by uncoupling the quick release strap handles and pulling them outwardly and away from one another, i.e., away from the body of the wearer and in opposite directions.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A quick release apparatus for selective connection and rapid disconnection of a rescue worker's waist belt from the support frame of a self-contained breathing apparatus, comprising:

first and second connector elements disposed on either the self-contained breathing apparatus support frame or the waist belt;

first and second quick release pull straps selectively and releasably coupled to said first and second connectors and connecting the self-contained breathing apparatus support frame to the waist belt, each of said first and second quick release pull straps having a quick release handle portion for grasping with a hand, such that by pulling one of said quick release handle portions away from the waist belt effects a partial release of the waist belt from the self-contained breathing apparatus support frame, and by pulling both of said handle portions of said first and second quick release pull straps, the waist belt is fully released from the self-contained breathing apparatus support frame, whereby the self-contained breathing apparatus may be removed by the wearer without also having to unbuckle or to remove the waist belt.

2. The apparatus of claim 1, wherein said first and second connector elements are snap elements and said first and second straps each include a strap snap element complementary to said first and second connector snap elements.

3. The apparatus of claim 2, wherein said each of said strap snap elements are disposed on said handle portion of its respective first and second quick release straps.

4. The apparatus of claim 1, wherein said first and second quick release straps are releasably connected to both the self-contained breathing apparatus support frame and the waist belt.

5. The apparatus of claim 1, wherein said first and second quick release straps are releasably connected to only one of the self-contained breathing apparatus support frame and the waist belt.

6. The apparatus of claim 5, wherein said first and second quick release straps are releasably connected to the waist belt.

7. The apparatus of claim 5, wherein said first and second quick release straps are releasably connected to the self-contained breathing apparatus support frame.

8. A quick release apparatus for selective connection and rapid disconnection of a rescue worker's waist belt from the support frame of a self-contained breathing apparatus, comprising:

first and second connector elements disposed on the waist belt;

first and second quick release pull straps disposed on the self-contained breathing apparatus support frame and selectively and releasably coupled to said first and second connectors on the waist belt, each of said first and second quick release pull straps having a quick release handle portion for grasping with a hand, such that by pulling both of said handle portions of said first and second quick release pull straps, the waist belt is fully released from the self-contained breathing apparatus support frame, whereby the self-contained breathing apparatus may be removed by the wearer without also having to unbuckle or to remove the waist belt.

* * * * *